US012221240B2

(12) United States Patent
Liang et al.

(10) Patent No.: US 12,221,240 B2
(45) Date of Patent: Feb. 11, 2025

(54) VACUUM PACKAGING METHOD AND VACUUM PACKAGING DEVICE

(71) Applicant: GUANGZHOU ARGION ELECTRIC APPLIANCE CO., LTD., Guangdong (CN)

(72) Inventors: Guoqiang Liang, Guangdong (CN); Zhicun Yin, Guangdong (CN); Changhui Lu, Guangdong (CN)

(73) Assignee: GUANGZHOU ARGION ELECTRIC APPLIANCE CO., LTD., Guangzhou (CN)

( * ) Notice: Subject to any disclaimer, the term of this patent is extended or adjusted under 35 U.S.C. 154(b) by 55 days.

(21) Appl. No.: 18/270,246

(22) PCT Filed: Oct. 20, 2021

(86) PCT No.: PCT/CN2021/124866
§ 371 (c)(1),
(2) Date: Jun. 29, 2023

(87) PCT Pub. No.: WO2022/142604
PCT Pub. Date: Jul. 7, 2022

(65) Prior Publication Data

US 2024/0059441 A1 Feb. 22, 2024

(30) Foreign Application Priority Data

Dec. 31, 2020 (CN) ..... 202011644594.1

(51) Int. Cl.
*B65B 31/02* (2006.01)
*B65B 51/10* (2006.01)
*B65B 57/00* (2006.01)

(52) U.S. Cl.
CPC ..... *B65B 31/02* (2013.01); *B65B 51/10* (2013.01); *B65B 57/00* (2013.01)

(58) Field of Classification Search
CPC ..... B65B 31/02; B65B 51/10; B65B 57/00; B65B 2051/105; B65B 31/00;
(Continued)

(56) References Cited

U.S. PATENT DOCUMENTS

2022/0402639 A1* 12/2022 Palumbo ..... B65B 57/00

FOREIGN PATENT DOCUMENTS

CN 1541177 A 10/2004
CN 107226236 A 10/2017
(Continued)

OTHER PUBLICATIONS

Matsuda, Machine Translation of JP-2001163367-A, Jun. 19, 2001 (Year: 2024).*
(Continued)

*Primary Examiner* — Veronica Martin

(57) ABSTRACT

A vacuum packaging method and device are provided. The method comprises acquiring size information of a package and selecting a suction constant b; controlling a door to seal the vacuum chamber after the package is disposed into a vacuum chamber; actuating a vacuum pump set and starting timing, and respectively recording time nodes $t_1$ and $t_2$ when a pressure detected inside the vacuum chamber is lowered to a first preset pressure $P_1$ and a second preset pressure $P_2$; calculating time difference $\Delta t$ by a formula $\Delta t=t_2-t_1$ based on $t_1$ and $t_2$; obtaining total suction time T or suction-stopping pressure P based on $\Delta t$ and b; continuously performing suction by the vacuum pump set, and controlling the vacuum pump set to stop suction once a suction time reaches T or the pressure inside the vacuum chamber is lowered to P; controlling a heater to finish heat-sealing.

8 Claims, 2 Drawing Sheets

(58) Field of Classification Search
CPC ..... B65B 31/022; B65B 31/024; B65B 51/14; B65B 47/02; B65B 7/164
See application file for complete search history.

(56) References Cited

FOREIGN PATENT DOCUMENTS

| | | | | |
|---|---|---|---|---|
| CN | 108137182 | A | | 6/2018 |
| JP | 2001163367 | A | * | 6/2001 |

OTHER PUBLICATIONS

International Search Report of PCT Patent Application No. PCT/CN2021/124866 issued on Jan. 17, 2022.

* cited by examiner

VACUUM PACKAGING METHOD AND VACUUM PACKAGING DEVICE

TECHNICAL FIELD

The disclosure relates to the technical field of vacuum packaging, more particularly to a vacuum packaging method and a vacuum packaging device.

BACKGROUND

Vacuum package machines are widely used in food-processing industry. During vacuum packaging and sealing process, existing vacuum package machines usually need operating personnel to manually calculate the period of suction time, so as to confirm completion of the suction process of the vacuum package machines. It has complicated algorithms and low calculating accuracy. It is time consuming and has data errors.

SUMMARY

To solve the above technical problems, an object of the disclosure is to provide a vacuum packaging method, which has advantages such as simple quick calculation with reduced error.

On such basis, the disclosure provides a vacuum packaging method, comprising steps of:

- acquiring size information of a package and selecting a suction constant b;
- controlling a door to seal a vacuum chamber after the package is disposed into the vacuum chamber;
- actuating a vacuum pump set and starting timing, and recording time node $t_1$ when a pressure detected inside the vacuum chamber is lowered to a first preset pressure $P_1$;
- continuously performing suction by means of the vacuum pump set, and recording time node $t_2$ when the pressure detected inside the vacuum chamber is lowered to a second preset pressure $P_2$;
- calculating time difference $\Delta t$ by a formula $\Delta t=t_2-t_1$ based on $t_1$ and $t_2$;
- obtaining total suction time T or suction-stopping pressure P based on $\Delta t$ and b;
- continuously performing suction by means of the vacuum pump set, and controlling the vacuum pump set to stop suction once a suction time reaches T or the pressure inside the vacuum chamber reaches P; and
- controlling a heater to finish heat-sealing.

In some embodiments of the disclosure, it may further comprise obtaining the total suction time T by calculating a formula $T=\Delta t*K+b$ based on $\Delta t$ and b, wherein K is an empirical coefficient.

In some embodiments of the disclosure, the empirical coefficient K=1/200.

In some embodiments of the disclosure, it may further comprise obtaining the suction-stopping pressure P by searching a preset database based on $\Delta t$ and b.

In some embodiments of the disclosure, after the step of controlling a door to seal the vacuum chamber after the package is disposed into a vacuum chamber, it may further comprise a step of determining whether the vacuum chamber is sealed by the door.

In some embodiments of the disclosure, the step of determining whether the vacuum chamber is sealed by the door comprises a step of continuously detecting a level of a pin of a gating switch, and confirming the vacuum chamber is sealed by the door once the level of the pin which is detected changes from high to low.

In some embodiments of the disclosure, after the step of controlling a heater to finish heat-sealing, it may further comprise a step of controlling the door to open the vacuum chamber.

In some embodiments of the disclosure, for packages manufactured to a variety of specifications, each specification of package individually corresponds to one value of suction constant b.

In order to solve same technical problems, the disclosure further provides a vacuum packaging device, comprising a device body, a control system, and a door, a vacuum pump set, a pressure sensor, and a gating switch, which are respectively electrically connected with the control system,

- wherein the device body is provided with a vacuum chamber for accommodating a package;
- the vacuum pump set arranged on the device body serves to suction gas inside the vacuum chamber;
- the pressure sensor arranged inside the vacuum chamber serves to detect a pressure inside the vacuum chamber and determine whether the pressure reaches the first preset pressure $P_1$, the second preset pressure $P_2$, and the suction-stopping pressure P;
- the door arranged on the device body serves to seal and open the vacuum chamber;
- the gating switch arranged on the device body serves to monitor a closed state and an opening state of the door; and
- the control system arranged on the device body serves to control the door to close and open, to control the vacuum pump set to close and open, to record time node $t_1$ and time node $t_2$, to record suction time, and to monitor a level of a pin of the gating switch in real-time.

Compared with the prior art, the vacuum packaging method according to the embodiment of the disclosure has advantages as follows.

The disclosure provides a vacuum packaging method, which detects information related to the size of the package and calculates suction time difference $\Delta t$ of the vacuum pump set from the time when the gas pressure inside the vacuum chamber reaches the two different preset values of pressure, so as to obtain the total suction time T or the suction-stopping pressure P of the vacuum chamber. Then, it can confirm whether suction of the vacuum pump set is finished, by determining whether the period of suction time reaches T or whether the pressure inside the vacuum chamber reaches P. It avoids conventional complicated and inaccurate manual calculation for suction time, has simple and reliable algorithm and reduces calculation error, and achieves quick calculation and saves time.

DETAILED DESCRIPTION OF ILLUSTRATED EMBODIMENTS

The embodiments of the disclosure will be further explained below in detail with reference to drawings and embodiments. The embodiments are illustrative and are not intended to limit the scope of the invention.

It should be noted that the terms such as "front" and "rear" used in the description are only used to distinguish one element from another and are not intended to limit the scope. For example, "front" element may refer to "rear" element, and "rear" element may refer to "front" element, without departing from the scope of the disclosure. In the description, "front" side refers to the side of the vacuum package which faces the operating personnel.

Figure 1:
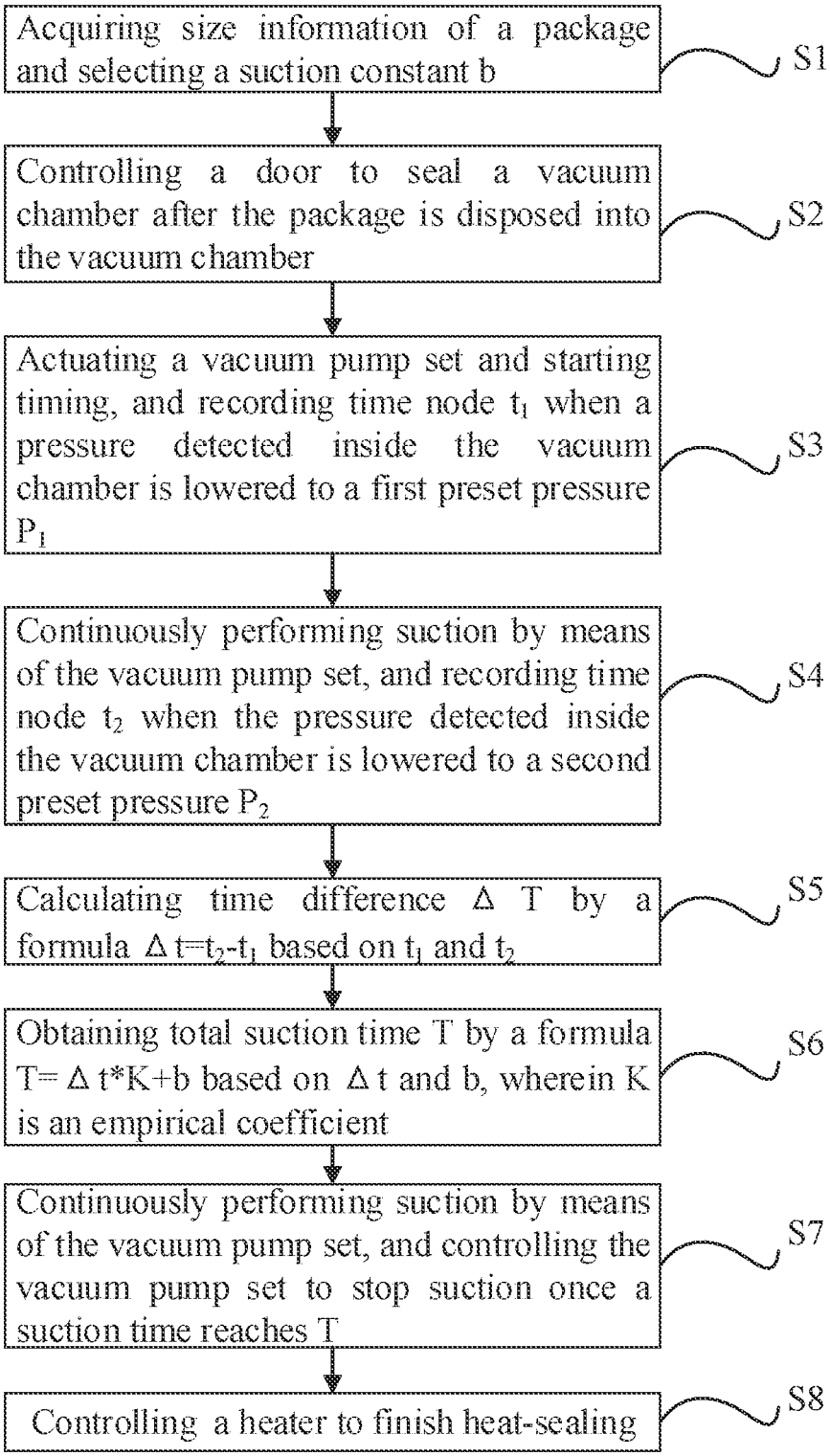
FIG. 1 is a process flow diagram which illustrates a vacuum packaging method according to an embodiment of the disclosure calculates a total suction time T.
Figure 2:
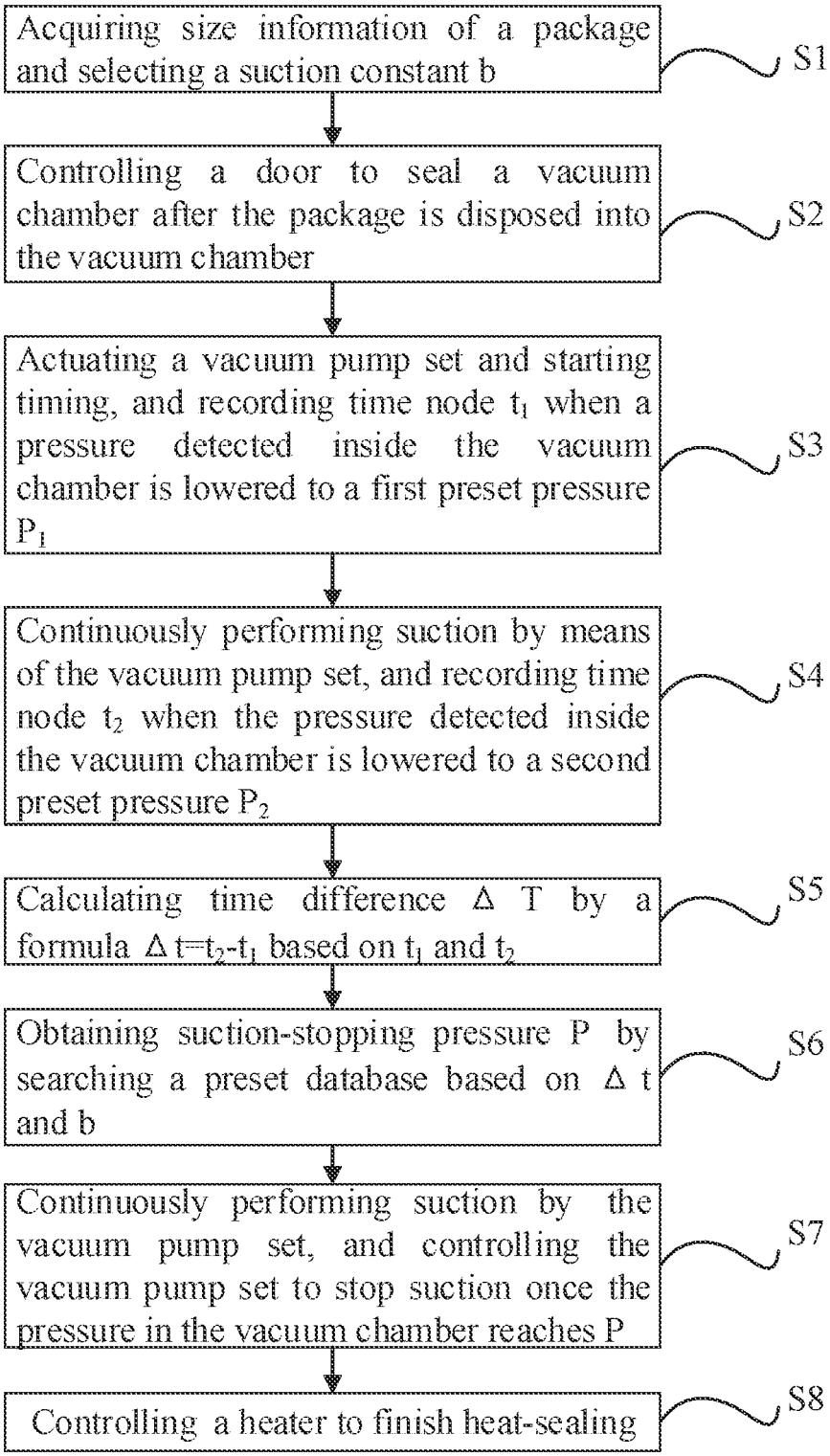
FIG. 2 is a process flow diagram which illustrates a vacuum packaging method according to an embodiment of the disclosure calculates a suction-stopping pressure.

Referring to FIGS. 1 and 2, the disclosure provides a vacuum packaging method, comprising steps of:

S1. Acquiring size information of a package and selecting a suction constant b;

S2. Controlling a door to seal a vacuum chamber after the package is disposed into the vacuum chamber;

S3. Actuating a vacuum pump set and starting timing, and recording time node $t_1$ when a pressure detected inside the vacuum chamber is lowered to a first preset pressure $P_1$;

S4. Continuously performing suction by means of the vacuum pump set, and recording time node $t_2$ when the pressure detected inside the vacuum chamber is lowered to a second preset pressure $P_2$;

S5. Based on $t_1$ and $t_2$, calculating time difference Δt by a formula $\Delta t=t_2-t_1$;

S6. Based on Δt and b, calculating total suction time T by a formula T=Δt*K+b, wherein K is an empirical coefficient; or, based on Δt and b, looking up a suction-stopping pressure P in preset database;

S7. Continuously performing suction by means of the vacuum pump set, and once a period of suction time reaches T or the pressure inside the vacuum chamber reaches P, controlling the vacuum pump set to stop suction;

S8. Controlling a heater to finish heat-sealing.

It should be noted that the order of the steps S1 and S2 in the embodiment of the disclosure is not fixed. In particular, right after acquiring size information of the package, the operating personnel may dispose the package into the vacuum chamber first and then control the door to seal the vacuum chamber. After that, the operating personnel may select the suction constant b based on the size information of the package. The steps in such alternative sequence can achieve the vacuum packaging operation as well.

Furthermore, after the step S2 of disposing the package into a vacuum chamber and then controlling a door to seal the vacuum chamber, the vacuum packaging method in some embodiments of the disclosure further comprises determining whether the vacuum chamber is sealed by the door, and in particular, continuously detecting the level of pins of a gating switch, and confirming the vacuum chamber is sealed by the door once it is detected that the level of the pin of the gating switch changes from high to low. After that, actuating the vacuum pump set and starting timing.

Alternatively, after the step S8 of controlling a heater to finish heat-sealing, the vacuum packaging method in some embodiments of the disclosure may further comprise:

S9. Controlling the door to open the vacuum chamber.

It should be noted that the formula T=Δt*K+b is obtained from repeated tests. In particular, the pressure sensor arranged inside the vacuum chamber may be preset with two pressure values, wherein the first preset pressure $P_1$ (e.g. −150 mbar) may be relatively high, and the second preset pressure $P_2$ (e.g. −650 mbar) may be relatively low. Thus, there is a difference value between the two preset pressure values, the two individual pressure values would be detected by the pressure sensor at two different time nodes during the suction process, and there is the time difference Δt between the two time nodes. To run repeated tests, objects of different volumes may be disposed in vacuum packages of the same size, respectively. Hence, several time differences Δt and total times T can be obtained, for example, by running a test on an object having a volume of one-tenth of the vacuum package to obtain a set of values Δt and T, and running a test on an object having a volume of two-tenth of the vacuum package to obtain another set of values Δt and T. In consequence, data related to several sets of values Δt and T can be obtained. Then, the formula T=Δt*K+b can be obtained after data processing and repeated testing and verification, and detail values of K and b can be obtained by testing and calculation. For vacuum packages of other size, corresponding values of K and b can be obtained similarly through the above mentioned testing and verification.

Furthermore, in order to reduce deviations and improve measurement accuracy, the vacuum packages of big, medium, and small sizes respectively need repeated tests to calculate optimal empirical coefficient K and suction constant b. After multiple tests on the packages of the three different sizes, it can be seen that the error of suction is minimized when the empirical coefficient K=1/200. That is, for a package of any of the three different sizes, the empirical coefficient K is preferably 1/200; for the packages of the three different sizes, the suction constant b has different preferred values.

Moreover, regarding Δt and P, the suction time difference Δt and the suction-stopping pressure P have an empirical relationship independently from the formula. In particular, each of the packages of different sizes has individual correspondence relationship between the values Δt and P. For example, for a package of small size, P equals −700 mbar when Δt is 1 s, and P equals −800 mbar when Δt is 2s. These correspondence relationships are obtained by repeated tests. The value of b facilitates the determination of the size of the package, and then facilitates the selection of corresponding database. In such a case, after Δt and b are detected, the control system can call to the database stored in the control system based on b, and look up corresponding suction-stopping pressure P in the database based on Δt. In consequence, when the pressure sensor detects that the pressure inside the vacuum chamber reaches P, the control system can control the vacuum pump set to stopping suction and finish following processes.

Alternatively, the packages may be manufactured to a variety of specifications. In particular, the packages in the embodiment of the disclosure may be classified into three sizes, i.e., big size, medium size, and small size, depending on length and width of the packages. Each size of packages individually corresponds to one value of suction constant b. It should be noted that the value of b, which is obtained by repeated tests and calculations, does not have any particular numerical relationship with the length and width of the packages. That is, the operating personnel selects a corresponding suction constant b depending on the length and width of the packages, rather than calculate the value of b based on the length and width of the packages. Obviously, the specification of the packages may be determined by other means. For example, it may be determined from the volume of the package, which is omitted herein.

In addition, in order to solve same technical problems, the disclosure further provides a vacuum packaging device, comprising a device body, a control system, and a door, a vacuum pump set, a pressure sensor, and a gating switch which are respectively electrically connected with the control system. Herein, the device body is provided with a vacuum chamber for accommodating a package; and the vacuum pump set is arranged on the device body, to suction the gas inside the vacuum chamber. The pressure sensor is disposed inside the vacuum chamber, to detect the value of the pressure inside the vacuum chamber and determine whether it reaches the first preset pressure $P_1$, the second preset pressure $P_2$, and the suction-stopping pressure P. The door for sealing and opening the vacuum chamber is disposed on the device body. The gating switch is disposed on the device body, to monitor the closed state and opening state of the door. The control system is disposed on the device body, to control the door to close and open, to control the vacuum pump set to close and open, to record time node $t_1$ and time node $t_2$, to record suction time, and to monitor level of the pin of the gating switch in real-time.

It should be noted that, the vacuum packaging device of the disclosure may provide unfixed number of pressure sensors. One, or two, or more than two pressure sensors may be provided. If the device has one pressure sensor, the one pressure sensor performs all detection of the first preset pressure $P_1$, the second preset pressure $P_2$, and the suction-stopping pressure P. If the device has two or more than two pressure sensors, the pressure sensors may be divided into groups, to detect the pressure inside the vacuum chamber and determine whether it reaches the first preset pressure $P_1$, the second preset pressure $P_2$, and the suction-stopping pressure P, respectively. In such a case, it further improves detection precision and reduces detection error. In practice, the operating personnel may determine the number of the pressure sensor based on some aspects such as the size of the vacuum chamber, the type of the object to be packaged, and the accuracy of the data to be detected.

To sum up, the disclosure provides a vacuum packaging method, which detects information related to the size of the package and calculates suction time difference Δt from the time when the gas pressure inside the vacuum chamber reaches the two preset values of the pressure so as to obtain the total suction time T. Compared with the prior art, it avoids conventional complicated and inaccurate manual calculation, has simple and reliable algorithm and reduces calculation error, and achieves quick calculation and saves time.

All the above are merely some preferred embodiments of the disclosure. It should be noted that the disclosure is intended to cover various modifications and equivalent arrangements included within the principle of the disclosure made by those skilled in the art.

The invention claimed is:

1. A vacuum packaging method, comprising steps of:

acquiring size information of a package and selecting a suction constant b;

controlling a door to seal a vacuum chamber after the package is disposed into the vacuum chamber;

actuating a vacuum pump set and starting timing, and recording time node $t_1$ when a pressure detected inside the vacuum chamber is lowered to a first preset pressure $P_1$;

continuously performing suction by means of the vacuum pump set, and recording time node $t_2$ when the pressure detected inside the vacuum chamber is lowered to a second preset pressure $P_2$;

calculating time difference Δt by a formula $\Delta t=t_2-t_1$ based on $t_1$ and $t_2$;

obtaining total suction time T or suction-stopping pressure P based on Δt and b, wherein the total suction time T is obtained by calculating a formula $T=\Delta t*K+b$ based on Δt and b, wherein K is an empirical coefficient;

continuously performing suction by means of the vacuum pump set, and controlling the vacuum pump set to stop suction once a suction time reaches T or the pressure inside the vacuum chamber is lowered to P;

controlling a heater to finish heat-sealing.

2. The vacuum packaging method according to claim 1, wherein the empirical coefficient K=1/200.

3. The vacuum packaging method according to claim 1, further comprising obtaining the suction-stopping pressure P by searching a preset database based on Δt and b.

4. The vacuum packaging method according to claim 1, further comprising, after the controlling the door to seal the vacuum chamber after the package is disposed into the vacuum chamber, a step of determining whether the vacuum chamber is sealed by the door.

5. The vacuum packaging method according to claim 4, wherein the determining whether the vacuum chamber is sealed by the door comprises continuously detecting a level of a pin of a gating switch, and confirming the vacuum chamber is sealed by the door once the level of the pin of the gating switch which is detected changes from high to low.

6. The vacuum packaging method according to claim 1, further comprising, after the controlling the heater to finish heat-sealing, a step of controlling the door to open the vacuum chamber.

7. The vacuum packaging method according to claim 1, wherein, for packages manufactured to a variety of specifications, each specification of package individually corresponds to one value of suction constant b.

8. A vacuum packaging device for performing the vacuum packaging method of claim 1, comprising a device body, a control system, and a door, a vacuum pump set, a pressure sensor, and a gating switch, which are respectively electrically connected with the control system, wherein the device body is provided with a vacuum chamber for accommodating a package;

the vacuum pump set arranged on the device body is configured to suction gas inside the vacuum chamber;

the pressure sensor arranged inside the vacuum chamber is configured to detect a pressure inside the vacuum chamber and determine whether the pressure reaches the first preset pressure $P_1$, the second preset pressure $P_2$, and the suction-stopping pressure P;

the door arranged on the device body is configured to seal and open the vacuum chamber;

the gating switch arranged on the device body is configured to monitor a closed state and an opening state of the door; and the control system arranged on the device body is configured to control the door to close and open, to control the vacuum pump set to close and open, to record time node $t_1$ and time node $t_2$, to record suction time, and to monitor a level of a pin of the gating switch in real-time.

* * * * *